United States Patent [19]

Kovac

[11] 4,156,299

[45] May 29, 1979

[54] HEAT EXCHANGER TUBE FERRULE

[75] Inventor: Lewis R. Kovac, Berkley, Mich.

[73] Assignee: The Detroit Edison Company, Detroit, Mich.

[21] Appl. No.: 417,715

[22] Filed: Nov. 21, 1973

[51] Int. Cl.[2] ..... B65D 55/00

[52] U.S. Cl. ..... 16/2; 16/108; 138/106; 138/113; 165/178; 248/56

[58] Field of Search ..... 138/106, 110, 113, 178, 138/DIG. 6; 165/178; 16/2, 108, 109; 174/48; 248/56

[56] References Cited

U.S. PATENT DOCUMENTS

| | | | |
|---|---|---|---|
| 882,556 | 3/1908 | Fitz et al. | 16/108 |
| 1,760,558 | 5/1930 | Klocke | 16/109 |
| 2,236,496 | 4/1941 | Beggs | 248/27.3 |
| 2,244,977 | 6/1941 | Hansman et al. | 85/36 |
| 2,355,126 | 8/1944 | Webster et al. | 16/2 |
| 2,870,242 | 1/1959 | Wilkerson | 16/108 |
| 3,332,479 | 7/1967 | Martin | 165/178 X |
| 3,380,208 | 4/1968 | Cook | 16/108 X |
| 3,559,730 | 2/1971 | Denjean | 165/178 |

FOREIGN PATENT DOCUMENTS

| | | | |
|---|---|---|---|
| 9094 of | 1910 | United Kingdom | 138/DIG. 3 |

OTHER PUBLICATIONS

La Que, F. L., Corrosion Resistant Steels in Sulphite Pulping, in the Paper Mill and Wood Pulp News, pp. 1–8, Dec. 5, 1936.

*Primary Examiner*—Richard E. Aegerter
*Assistant Examiner*—James E. Bryant, III
*Attorney, Agent, or Firm*—Whittemore, Hulbert & Belknap

[57] ABSTRACT

A tube ferrule for a heat exchanger such for example as a condenser, a boiler, a refrigeration unit, or the like, having the shape of a longitudinally or axially split generally tubular or cylindrical ferrule having radially outwardly extending edge flanges adapted to be compressed and inserted so as to surround the portion of a tube occupying a circular opening in a support plate somewhat larger than the tube.

2 Claims, 5 Drawing Figures

FIG. 1
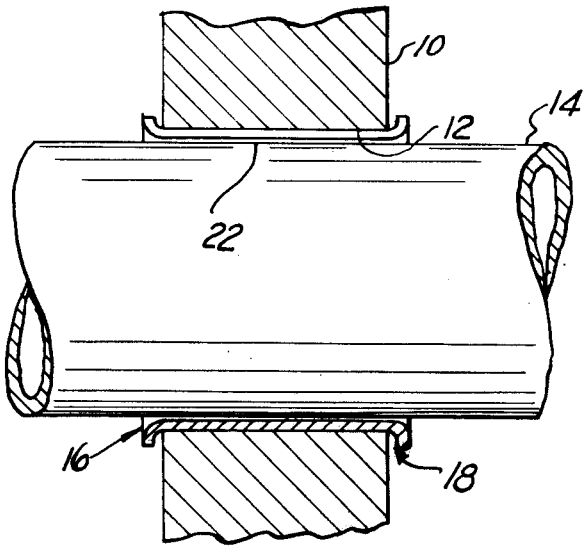
FIG. 2
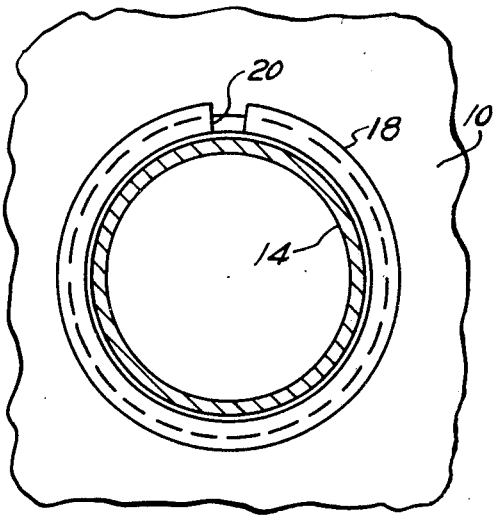
FIG. 3
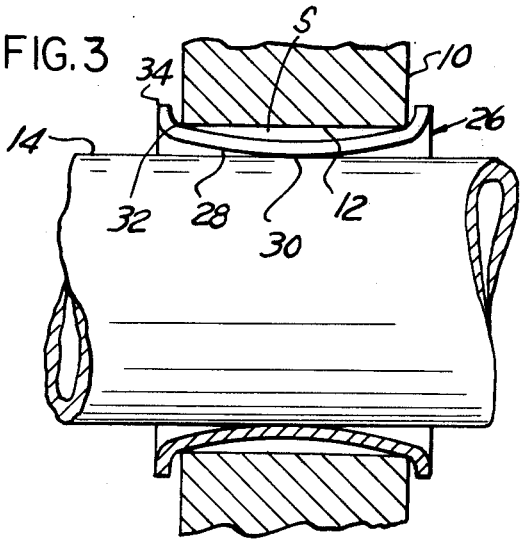
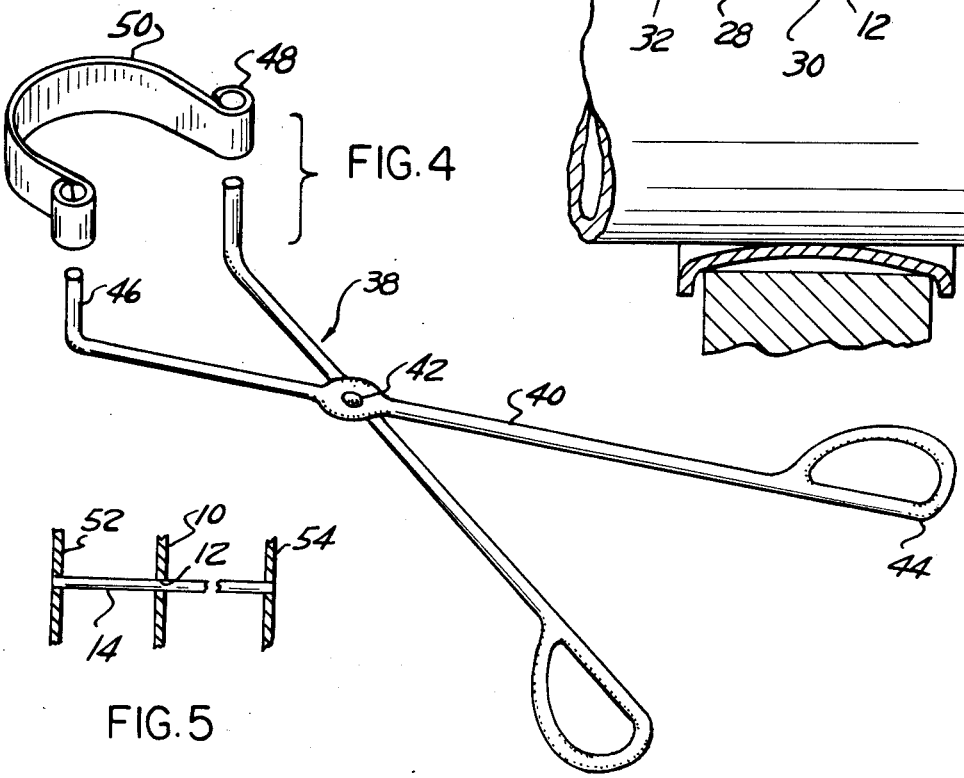
FIG. 4
FIG. 5

HEAT EXCHANGER TUBE FERRULE

BRIEF SUMMARY OF THE INVENTION

Heat exchangers such for example as steam condensers, boilers, refrigeration units, or the like, conventionally comprise a multiplicity of tubes, the ends of which are received in circular openings in header plates and are enlarged so as to be retained firmly in such openings. The intermediate portions of the tubes extend through circular openings in support plates which extend parallel to the header plates. The openings in the support plates are conventionally formed by operations which produce openings substantially larger than the tubes and these openings are not ordinarily located with great precision.

Accordingly, the support of intermediate portions of tubes by support plates has been subject to objectionable looseness or lack of adequate support which has led to vibration.

A further objection to heat exchangers as presently constructed is the presence of oversize holes in the tube support plate caused either by initial machining or in some cases by corrosion.

A further objection is that when openings are provided most economically in tube support plates without careful machining, they tend to produce rough portions which gall or score tubing as it is inserted.

Finally, a fourth objectional feature of the present construction of heat exchangers is that the different materials used in the tubes and in the tube support plates often leads to undesirable galvanic action.

By employing the ferrules having the general shape of longitudinally or axially split tube or cylinder and formed of appropriate material, the foregoing objections are substantially reduced or eliminated.

In the first place, the use of the ferrule permits initial formation of the holes in the tube support plate to be substantially oversize so that great care in sizing the holes and insuring accuracy of location need not be employed.

In the second place, the formation of these holes may be by operations which inherently leave the perimeter of the holes in a rough or unfinished condition so that without the ferrules, scoring or galling of the tubes would take place. The ferrules when inserted, provide a smooth surface engaging the outer surface of the tubes both during installation and operation, and thus minimizing or eliminating the possibility of scoring and galling.

In the third place, by selecting a proper material for the ferrule, galvanic action between the tube and the tube support plate may be eliminated.

In the fourth place, vibration of the tube in use is reduced or eliminated by (a) limiting radial movement of the tube in the opening in the tube support plate, (b) applying a restraint to the radial movement of the tube in the opening in the tube support plate by virtue of the spring-like or elastic properties of the ferrule, and (c) the hydraulic clamping action of the condensate liquid entrapped between the outside surface of the ferrule and the internal surface of the hole or opening in the tube support plate.

BRIEF DESCRIPTION OF THE DRAWINGS

FIG. 1 is an enlarged view, partly in section, showing a portion of a tube surrounded by a ferrule extending through an opening in a tube support plate.

FIG. 2 is an end view of the fragmentary construction shown in FIG. 1.

FIG. 3 is a partly sectional view similar to FIG. 1 illustrating a modified form of ferrule.

FIG. 4 is an exploded view of a special tool for applying the ferrules into the openings in the support plates.

FIG. 5 is a fragmentary view illustrating the relationship between a tube header plate and a support plate.

DETAILED DESCRIPTION

Referring first to FIGS. 1 and 2 there is shown a portion of a tube support plate 10 which is adapted to be located between and to extend parallel to opposed header plates. The support plate is provided with a multiplicity of cylindrical openings 12 of round or circular cross-section which are dimensioned to receive intermediate portions of tubes 14. As will be apparent from an inspection of FIG. 1, the diameter of the tube 14 is substantially less than the inside diameter of the opening 12. By providing the relatively enlarged openings 12 as illustrated in the Figure, it is possible to produce the intermediate support plates more economically since the dimensions of the tube support openings or holes need not be maintained with great accuracy.

Received in the opening 12 and surrounding the tube 14 is a generally cylindrical ferrule 16 having the shape of a longitudinally or axially split continuous tube or cylinder. It is to be understood that this description of the shape of the ferrule is not intended to suggest the method of making the ferrule. The axially opposite ends of the ferrule are provided with relatively short radially outwardly extending retainer flanges 18. The ferrule, as best seen in FIG. 2, has free, axially extending separated edges as indicated at 20 which are movable toward and away from each other to provide for contraction or expansion of the ferrule.

The ferrule is preferably formed of a resilient metal although it may be formed of a suitable reinforced plastic material. In any case, the ferrule when contracted and placed in the opening 12 of the plate 10 as illustrated in the Figures, is permitted to expand so that its outer surface contacts the inner surface of the opening 12. A very small clearance, as indicated at 22, exists between the outer surface of the tube 14 and the inner surface of the ferrule 16.

Referring now to FIG. 3 there is shown a somewhat different form of ferrule indicated generally at 26, received in the opening 12 in the tube support plate 10. In this case the opening 12 is or may be somewhat larger than the opening illustrated in FIG. 1 for a tube 14 of the same size as illustrated in FIG. 1.

In this case the ferrule 26, while having the shape of a longitudinally or axially split tube or cylinder has its intermediate portion between its axially opposite ends longitudinally bowed to provide an internal longitudinally rounded convex surface 28 which is adapted to maintain contact with the outer surface of the tube 14 as indicated at 30. At the same time, the end portions of the ferrule, due to its resilience, expand outwardly so as to maintain contact with the ends 32 of the opening 12. Thus, in this case the ferrules 26 substantially close the space between the outer surface of the tube and the openings, except for the gap left between the longitudinally extending adjacent edges of the ferrule. Moreover, with this construction, the tube 10 is supported by the ferrule against any lateral movement.

In this case, as in the embodiment of the invention illustrated in FIGS. 1 and 2, the axially opposite ends of ferrule 26 are provided with relatively short radially outwardly extending flanges 34 which retain the expanded ferrules in the tube opening after insertion.

It will be understood that the ferrules are inserted in the openings in the support plates prior to insertion of the tubes through the openings in the plates. In order to collapse the ferrules sufficiently to permit the end flanges 18 or 34 of the ferrules to pass through the openings, the special tool provided in FIG. 4 is provided. This tool comprises a scissor type tong device 38 comprising arms 40 which are pivotally connected as indicated at 42 and which are provided at corresponding ends thereof with loops 44 for manipulation by the fingers of the operator. At the opposite ends the arms 40 have laterally extending fingers 46 which are received within looped end portions 48 of a flexible band 50. The length of the band 50 is selected in accordance with the dimensions of the ferrule, and in use the tongs 38 are employed to cause the fingers 46 to move towards each other to cause the flexible strap or band 50, which surrounds a ferrule, to collapse the ferrule sufficiently so that it may be inserted in the opening 12 of the support plate 10. After the ferrule has been inserted or partially inserted in the opening 12, the tongs 38 are released to permit the ferrule to expand into contact with the surface of the opening 12. If the ferrule has not been completely inserted to final position it may be pressed axially into the opening until properly located, at which time the radially outwardly extending flanges 18 or 34 will move to the position illustrated in FIGS. 1 and 3, thus retaining the ferrule in place.

After insertion of the ferrules, the heat exchanger may be assembled by inserting the tubes through the intermediate support plates as in the past and by rolling-in the ends of the tubes in the openings provided in the header plates.

For completeness, there is illustrated in FIG. 5 a portion of a heat exchanger comprising spaced parallel header plates 52 and 54, a single intermediate support plate 10, and a single tube 14. The ends of the tube 14 are conventionally expanded by rolling into openings in the header plates 52 and 54. A plurality of tube support plates 10 are provided in accordance with the dimensions of the heat exchanger. The tube support plate 10 is provided with a multiplicity of openings 12 which are dimensioned to receive intermediate portions of a similar multiplicity of tubes.

Reference was previously made to the elimination or suppression of galvanic action between the tubes 14 and the support plates 10. The support plates are conventionally made of carbon steel and where the tubes are formed of admiralty brass, such for example as 70-30 CuNi, or monel metal, undesirable galvanic action takes place between the tubes and the plate. The ferrules may be made of 430 stainless steel which will have the effect of largely eliminating galvanic action.

In a specific example, the tube support plate is apertured for the reception of 1′ and the openings for receiving the tubes have an internal diameter of 1.015–1.031 inches. The ferrules are formed from stock having a thickness of only a few thousandths of an inch, as for example between 0.003–0.006 inch. It is of course possible to provide the holes in the support plate somewhat larger so that the thickness of the material from which the ferrules are formed may be increased for example up to about 0.010 inch.

Preferably, the radial extension of the flanges 18 and 34 is such that when the tube 14 has been inserted through the ferrule while the ferrule is located in an opening in the tube support plate, the tube prevents sufficient collapse of the ferrule to permit its removal from the opening in the tube support plate. In other words, once the tube and ferrule have been assembled in the relationship illustrated in FIGS. 1 and 3, the ferrule cannot be removed without removing the tube.

It is pointed out that after extensive use, it is sometimes the practice to disassemble the components of the heat exchanger and prior to the present invention, this has led to the discovery that in many cases, due to corrosion or galvanic action, the openings through the tube support plate have become enlarged. An important use of the present invention is to permit the reuse of such tube support plates with enlarged openings, by in effect reducing the size of the openings by insertion of the tube support ferrules.

It is pointed out that in either embodiment of the ferrule, an important constructional feature is that the inner surface of the ferrule, including the curved end portions, is completely smooth so as to avoid scoring or galling of the tube. Moreover, the provision of the radially outwardly bent flange portions provides smoothly rounded surfaces which are effective to prevent scoring or galling even if an opening in a tube support plate may be somewhat out of alignment with the corresponding openings in the header plate or in adjacent support plates.

It was previously pointed out that the ferrule prevents vibration of the tube by three specific actions, one of which is by trapping condensate in the space designated S in FIG. 3. The space S is annular, and of a cross-section which, due to the transversely concave configuration of the outer surface of the ferrule in conjunction with the cylindrical opening 12, is tapered at the ends where contact is made between the ends 34 of the opening 12 and the end portions of the ferrule. Condensate is partially trapped in this space, since end portions of the ferrule engage the corners at the ends 32 of the tube opening, and flow of condensate between the annular space S and the surrounding space takes place only through the space between the axially extending edges as indicated at 20.

As seen in FIG. 3, the ferrule extends very nearly but not completely around the tube or the circumference of the opening, or slightly less than 360°. The ferrule may be contracted as by tool 38, so that the flanges 34 at one end may pass through the opening 12. When the tube 14 is thereafter inserted, the ferrule is positively retained in the opening.

What I claim as my invention is:

1. A ferrule for insertion in a tube-receiving opening in a tube support plate in a heat exchanger in which the openings are oversize with respect to the tube diameters, in which the ferrules protect the tubes against rough surfaces in the tube openings, and in which the ferrules prevent vibration of the tubes within the openings by limiting radial movement of the tubes in the openings, yieldably resisting such radial movement, and providing a hydraulic action as a result of condensate liquid entrapped in the space between the outside surface of the ferrule and the inner surface of the opening and moving into and out of the space between the longitudinal edges of the ferrule, said ferrule being formed of thin resilient stainless steel having a thickness of about 0.003–0.010 inches, said ferrules having the general shape of a longitudinally or axially split tube or cylinder having longitudinally extending spaced opposed edge portions movable toward and away from each other to decrease or increase the effective diameter of the ferrule to accommodate variations in size of plate openings, said ferrule extending very nearly around the tube or slightly less than 360°, said ferrule having radially outwardly extending retainer flanges engageable with opposite sides of a tube support plate, the movement of said longitudinally or axially extending edges of said ferrule toward and away from each other providing for reduction of diameter of the ferrule to permit the radially outwardly extending flanges at one end of the ferrule to pass through a tube opening before a tube is positioned in the opening, the wall of said ferrule between said flanges being of circular shape in cross-section and having a diameter which increases gradually from a zone midway between the ends of the ferrule to the end flanges thereby providing an inner surface which is convex in longitudinal section and an outer surface which is concave in longitudinal section, to define a generally annular space between the outer surface of said ferrule and the inner surface of a cylindrical plate opening in which said ferrule is received, which space is tapered from the mid-portion of the ferrule substantially to the ends thereof, where contact is made between the ends of the plate opening and end portions of the ferrule, to provide for flow of condensate between said annular space and the surrounding space between the spaced longitudinal edges of the ferrule.

2. A ferrule as defined in claim 1 in which said flanges provide rounded surfaces merging smoothly into the internal ferrule surface adjacent the ends thereof.

* * * * *